US006756134B2

(12) United States Patent
Hodgens et al.

(10) Patent No.: US 6,756,134 B2
(45) Date of Patent: Jun. 29, 2004

(54) ZINC-DIFFUSED ALLOY COATING FOR CORROSION/HEAT PROTECTION

(75) Inventors: Henry M. Hodgens, Lake Worth, FL (US); Thomas R. Hanlon, Colchester, CT (US); Promila Bhatia, Farmington, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/252,867

(22) Filed: Sep. 23, 2002

(65) Prior Publication Data

US 2004/0058189 A1 Mar. 25, 2004

(51) Int. Cl.[7] ..... C25D 5/48; C25D 5/50; B32B 15/01

(52) U.S. Cl. ..... 428/658; 428/659; 428/679; 428/941; 148/537; 148/533

(58) Field of Search ..... 428/658, 659, 428/941, 679; 148/537, 533

(56) References Cited

U.S. PATENT DOCUMENTS 3,808,031 A * 4/1974 Brill-Edwards ..... 427/252
4,416,737 A * 11/1983 Austin et al. ..... 205/99
4,786,377 A * 11/1988 De Filippo et al. ..... 428/658
4,859,289 A * 8/1989 Nishimura et al. ..... 205/149
5,176,812 A * 1/1993 Suda et al. ..... 205/228
5,246,786 A * 9/1993 Usui ..... 428/621
5,304,401 A * 4/1994 Shindou et al. ..... 427/410
5,330,850 A * 7/1994 Suzuki et al. ..... 428/623
5,494,706 A * 2/1996 Abe et al. ..... 427/329
5,595,831 A * 1/1997 Clark ..... 428/679
6,040,054 A * 3/2000 Odashima et al. ..... 428/413
6,500,565 B2 * 12/2002 Usui ..... 428/623
6,527,841 B2 * 3/2003 Matzdorf et al. ..... 106/14.44

* cited by examiner

*Primary Examiner*—Deborah Jones
(74) *Attorney, Agent, or Firm*—Bachman & LaPointe, P.C.

(57) ABSTRACT

The present invention relates to a zinc-diffused nickel alloy coating for corrosion and heat protection and to a method for forming such a coating. The coating method broadly comprises the steps of forming a plain nickel or nickel alloy coating layer on a substrate, applying a layer of zinc over the nickel or nickel alloy coating layer, and thermally diffusing the zinc into the nickel alloy coating layer. The coating method may further comprise immersing the coated substrate in a phosphated trivalent chromium conversion solution either before or after the diffusing step. The substrate may be a component used in a gas turbine engine, which component is formed from a steel material.

21 Claims, 3 Drawing Sheets

ZINC-DIFFUSED ALLOY COATING FOR CORROSION/HEAT PROTECTION

BACKGROUND OF THE INVENTION

The present invention relates to a steel substrate having a zinc diffused nickel alloy coating thereon and to a method for forming same.

Steel products are subject to damage from atmospheric corrosion and must be protected. This is often accomplished by applying a protective coating such as an organic film (paint) or a metallic coating (electroplate). Steel is also subject to heat oxidation at high temperatures and, if it is to be subjected to this environment, it must be protected via an appropriate coating. Electroplated or sprayed metal coatings or metallized paints are often used to provide resistance to high heat environments, such as those found in gas turbine engines. Problems arise when both heat and atmospheric corrosion protection are needed. Coatings resistant to high heat generally do not impart effective atmospheric corrosion protection, while typical coatings capable of preventing atmospheric corrosion offer little thermal protection beyond 420° C. (approximately 790° F.)

SUMMARY OF THE INVENTION

Accordingly, it is an object of the present invention to provide a coating which provides both heat and atmospheric corrosion protection.

It is yet another object of the present invention to provide a method for forming the above coating.

The foregoing objects are attained by the coating and the method of the present invention.

In accordance with a first aspect of the present invention, a method for forming a corrosion and heat protective coating on a substrate is provided. The method broadly comprises the steps of forming a nickel base coating layer on the substrate, applying a layer of zinc over the nickel alloy coating layer, and diffusing the zinc into the nickel alloy coating layer. If desired, the coated substrate may be immersed in a phosphated trivalent chromium conversion solution either before or after the diffusing step.

In accordance with a second aspect of the present invention, a steel substrate having at least one surface and a zinc diffused nickel alloy coating on the at least one surface is provided.

Other details of the method and the coatings of the present invention, as well as other-objects and advantages attendant thereto, are set forth in the following detailed description and the accompanying drawings wherein like reference numerals depict like elements.

DETAILED DESCRIPTION OF THE PREFERRED EMBODIMENT(S)

The present invention consists of diffusing zinc into an existing nickel base coating that has been previously deposited on a substrate. The zinc diffused nickel alloy coatings of the present invention may be applied to substrates formed from a wide range of materials, but have particularly utility with a substrate formed from a steel material such as a deoxidized, low carbon steel alloy designated C1010.

Figure 1:
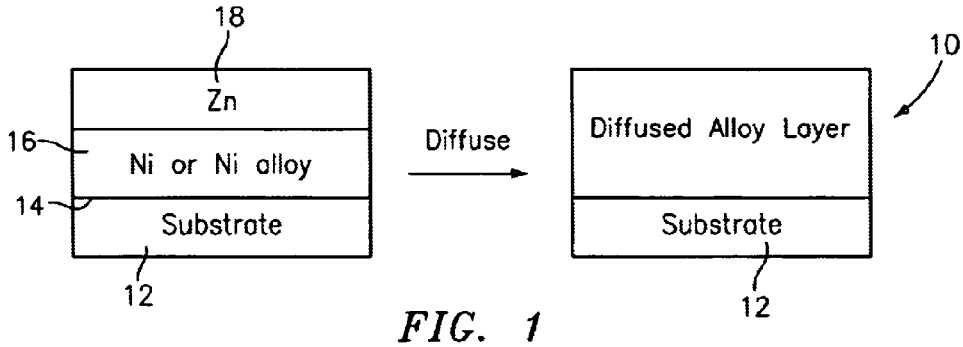
FIG. 1 is a schematic representation of a zinc-diffused nickel alloy coating process.

FIG. 1 illustrates a process for forming a zinc diffused nickel alloy coating 10 in accordance with the present invention. The process begins with the provision of a clean substrate 12, preferably formed from a steel material. The substrate 12 may be a component to be used in a gas turbine engine. A plain nickel or nickel alloy layer 14 is deposited on at least one surface 16 of the substrate 12. Any suitable technique known in the art may be used to deposit the nickel or nickel alloy layer 14. Preferably, the nickel or nickel alloy layer 14 is deposited at a rate of approximately 12.0 $\mu$m per hour via an electroplating bath operated at a temperature in the range of room temperature (approximately 68° F. (approximately 20° C.)) to 130° F. (approximately 55° C.). The composition of the electroplating bath depends on the nickel material to be plated. A typical bath composition for depositing a nickel cobalt alloy comprises 48 to 76 g/l Ni, 1.7–2.9 g/l Co, 15–40 g/l boric acid, 4.0–10 g/l total chloride (from $NiCl_2$-$6H_2O$) having a pH in the range of 3.0 to 6.0, preferably 4.5 to 5.5. Other suitable nickel alloys which may be deposited include NiFe, NiMn, NiMo, and NiSn. When a NiCo alloy is to be deposited, the cobalt content in the deposited layer should be in the range of 7.0 to 40 wt %. The plating process may be carried out at a current density in the range of 0.5 amps/dm$^2$ to 4.304 amps/dm$^2$ with the bath being maintained at a pH in the range of 2.0 to 6.0. The nickel containing layer 14 may have a thickness in the range of 2.0–20 $\mu$m, preferably 1.0 to 14 $\mu$m, and most preferably 8.0 to 11 $\mu$m.

After deposition of the nickel containing layer 14 on the substrate 12, a zinc layer 18 is deposited on the nickel or nickel alloy layer 14. The zinc layer may be deposited using any suitable technique known in the art. Preferably, the zinc layer is deposited using an electroplating technique which deposits the zinc at a rate of approximately 1 $\mu$m per minute at room temperature. The zinc electroplating chemistry may be primarily zinc sulfate with added sodium acetate and chloride salts. A zinc metal concentration of between 8.8 g/l to 45 g/l may be used. The sodium salts are used to provide a suitable bath conductivity. The zinc layer may be deposited from moderate to mildly agitated, room temperature solutions. A suitable zinc bath chemistry which may be used comprises 442.5 g/l $ZnSO_4$-$7H_2O$, 26.5 g/l $Na_2SO_4$, 13.8 g/l $CH_3COONa$-$3H_2O$, and 1.0 g/l NaCl. The bath may have a pH in the range of 4.8 to 6.2 and may be adjusted with either NaOH or $H_2SO_4$. A current density in the range of 3.228 amps/dm$^2$ to 8.608 amps/dm$^2$ may be used to plate the zinc layer. The zinc layer 18 may have a thickness in the range of 0.8 to 14 $\mu$m, preferably 2.0 to 14.0 $\mu$m, and most preferably 4.0 to 7.0 $\mu$m.

The zinc in the layer 18 may be diffused in the nickel alloy layer 14 using any suitable technique known in the art. Preferably, a thermal diffusion technique is utilized. The thermal diffusion technique may be carried out in either an atmospheric or an inert gas oven at a temperature in the range of 600° to 800° F. (315 to 427° C.) for a time period of at least 100 minutes. If desired, the thermal diffusion technique may be carried out in two steps where the substrate 12 with the nickel alloy and zinc layers 14 and 18 is subject to a first temperature in the aforesaid range for a time in the range of 80 to 100 minutes and to a second temperature in the aforesaid range, preferably higher than the first temperature, for a time in the range of 20 to 60 minutes.

To show the effectiveness of the coatings of the present invention, the following tests were performed.

Experimental test panels formed from clean and deoxidized, low-carbon steel coupons were coated with a NiCo layer from a 500 ml test bath operated at room temperature with moderate agitation. The alloy layers were deposited over a current density range of 0.5 to 4.0 amp/$dm^2$. The NiCo bath had a composition of 62 g/l Ni, 2.3 g/l Co, 27.5 g/l boric acid, 7 g/l total chloride and a pH of 5 which was adjusted with NaOH or $H_2SO_4$. The Zn electroplating bath was formulated to have a zinc metal concentration of between 8.0 to 45 g/l. Potassium or ammonium chloride salts were used to provide the desired bath conductivity. The zinc layers on the test coupons were deposited from moderately agitated, room temperature solutions. Diffusion was performed in two stages, most typically by holding the sample first at 630° F. (332° F.) for 90 minutes followed by one hour at 730° F. (388° C.).

Figure 2:
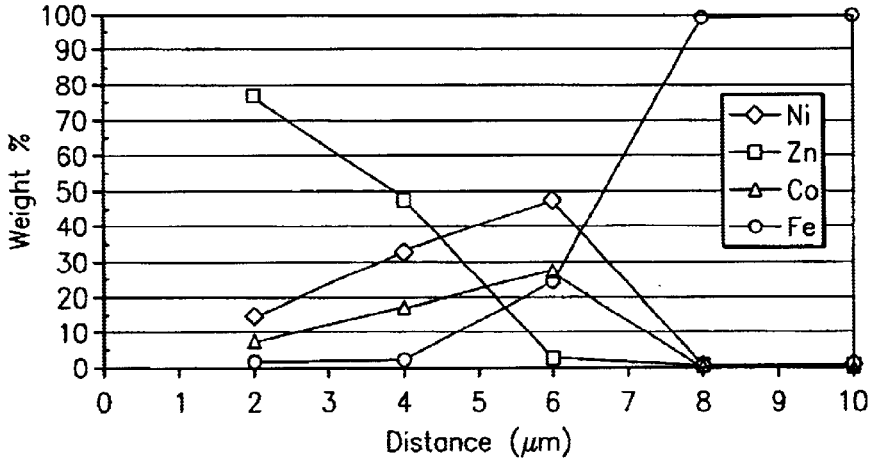
FIG. 2 is a graph showing the concentration profile of a diffused nickelcobalt-zinc coating on a steel substrate.

X-ray maps of the samples indicated that zinc atoms had diffused throughout the NiCo layer right up to the NiCo—Fe interface and that, to a lesser degree, both nickel and cobalt atoms had diffused into the zinc layer. The concentration profile plot of FIG. 2 shows the sort of elemental concentration gradient established by the diffusion process for a 5.4 $\mu$m coating which initially had approximately 3.0 $\mu$m of NiCo under approximately 2.0 $\mu$m of zinc. Indications are that 80% of the metal atoms at the coating surface are zinc and the zinc content drops to practically zero at the NiCo—Fe interface.

Figure 3A:
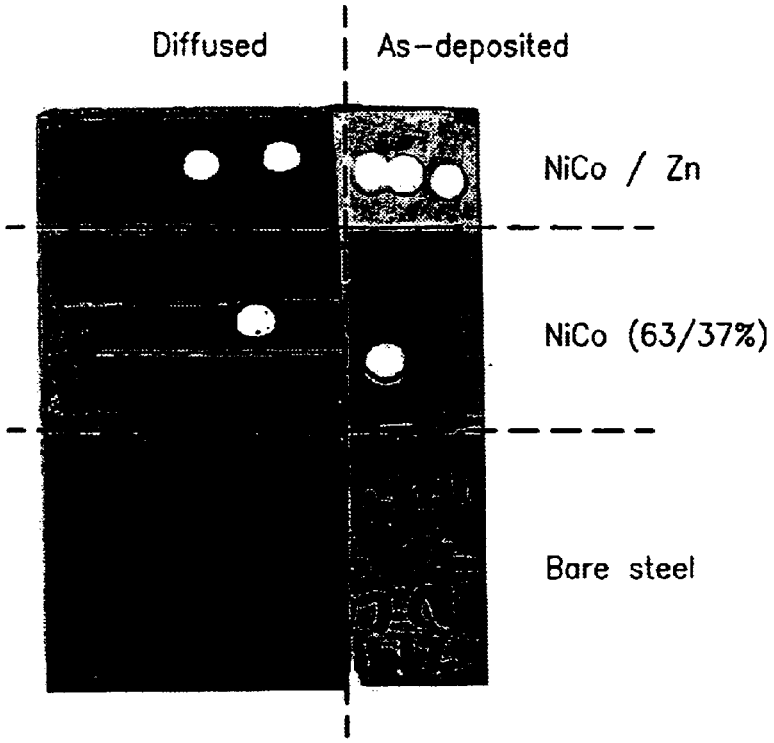
FIGS. 3A and B illustrate a NiCo—Zn coated steel panel after 20 hours of ASTM B117 salt fog exposure.
Figure 3B:
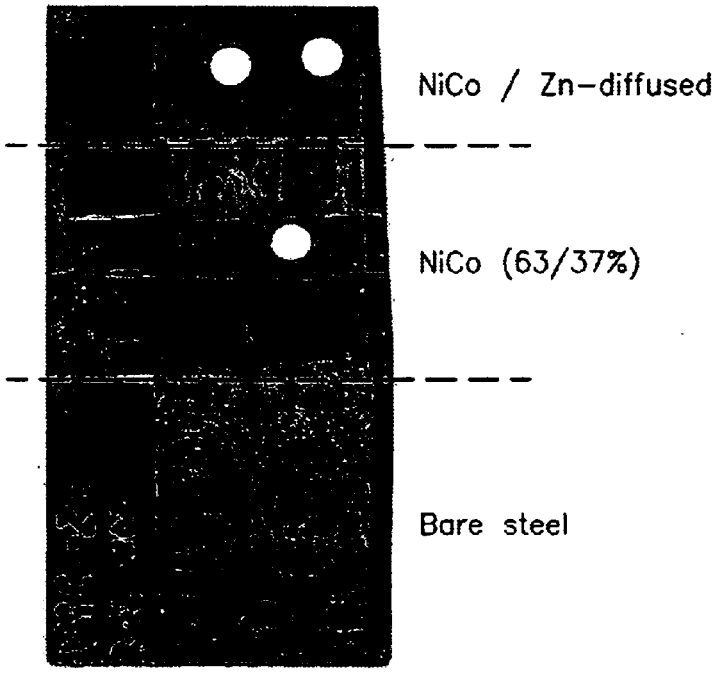

FIGS. 3A and 3B illustrate how the added Zn enhances performance of the coatings of the present invention upon exposure to a corrosive environment. FIG. 3A shows coating as-grown before (right) and after (left) the thermal diffusion cycle. FIG. 3B depicts the condition following exposure to an ASTM B117 salt fog for 20 hours. Edges of the samples were masked with plater's tape. Severe red rust on the bare steel section indicated the width of the exposed strip. NiCo in an amount of 63% Ni/37% Co alone offered some resistance to corrosion, but damaged areas appear highly susceptible to corrosion (a hole punch was used to sample coating). Only the top section, where a thin layer of zinc was deposited and later thermally diffused, showed enhanced resistance to corrosive attack.

Figure 4:
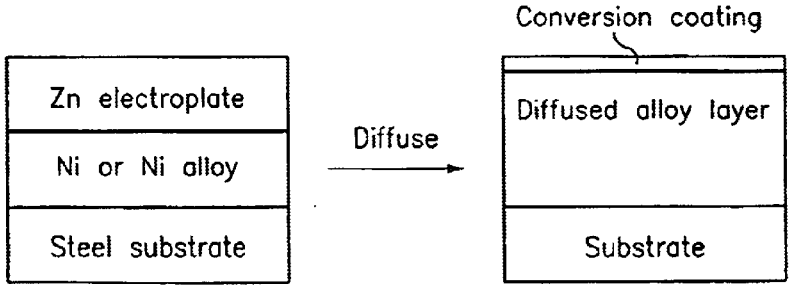
FIG. 4 is a schematic representation of an alternative zinc-diffused nickel alloy coating process.

Referring now to FIG. 4, if desired, the coated substrate may be immersed in a phosphated trivalent chromium conversion solution. The immersion step may take place either prior to the final diffusion step or subsequent to the diffusion step.

The phosphated trivalent chromium conversion solution comprises a water soluble trivalent chromium compound, a water soluble fluoride compound, and a corrosion improving additive which may also reduce precipitation of trivalent chromium. The additive may comprise a chelating agent or a bi- or multi-dentate ligand. Generally, the additive is present in an amount of between 5 ppm to 100 ppm with respect to the total coating solution, preferably between 15 ppm to 30 ppm with respect to the total coating solution. The preferred additives for corrosion inhibition include the derivatives of the amino-phosphoric acids, e.g. the salts and esters like nitrilotris (methylene) triphosphoric (NTMP), hydroxy-amino-alkyl phosphoric acids, ethyl imido (methylene) phosphoric acids, diethyl aminomethyl phosphoric acid, etc., may be one or the other or a combination provided the derivative is substantially soluble in water. A particularly suitable additive for use as a corrosion inhibitor and solution stability additive is nitrilotris (methylene) triphosphoric acid (NTMP).

The diluted acidic aqueous solution comprises a water soluble trivalent chromium compound, a water soluble fluoride compound, and an amino-phosphoric acid compound. The trivalent chromium compound is present in the solution in an amount of between 0.2 g/l to 10.0 g/l (preferably between 0.5 g/l to 8.0 g/l), the fluoride compound is present in an amount of between 0.2 g/l to 20.0 g/l (preferably 0.5 g/l to 18.0 g/l). The diluted trivalent chromium coating solution has a pH between 2.5 to 4.0.

By using a coating solution containing trivalent chromium in the amounts between 100 ppm to 300 ppm, fluoride in the amount between 200 ppm to 400 ppm, and corrosion inhibitive amino-phosphoric acid compound in the amounts between 10 ppm to 30 ppm, excellent corrosion protection is obtained and precipitation of trivalent chromium is reduced over time.

The coated substrate may be immersed in the phosphated trivalent chromium conversion solution for a time period in the range of 5 seconds to 15 minutes, preferably at least 30 seconds.

Figure 5A:
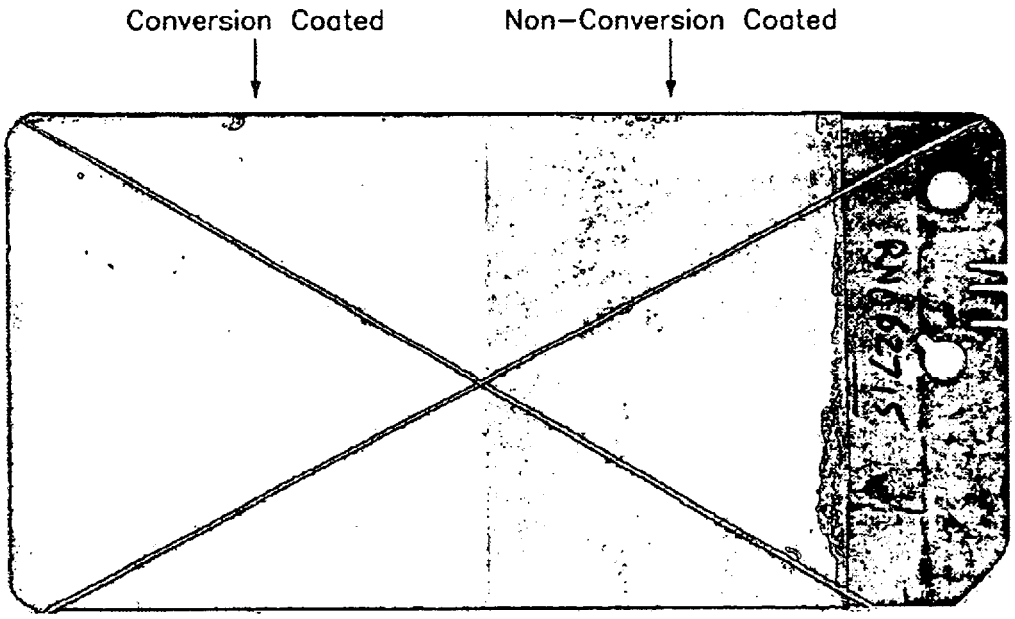
FIGS. 5A and 5B illustrate a partially conversion coated sample before and after 199 hours ASTM Salt Fog exposure.
Figure 5B:
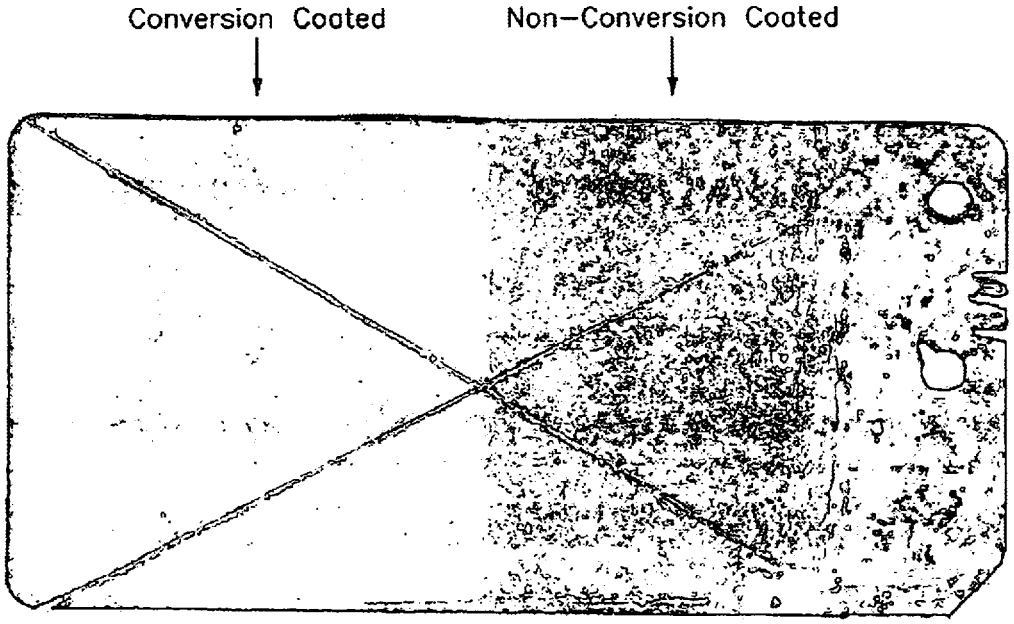

FIGS. 5A and 5B show a scribed nickel-zinc coated coupon that was conversion coated in accordance with the present invention on only the left half prior to salt fog exposure. FIG. 5B is the same coupon after 199 hours of ASTM B117 salt fog exposure. Comparing FIGS. 5A and 5B reveals how the conversion coated area was more resistant to corrosion, especially within the scribes. The conversion coated half of the sample also had better overall appearance compared to the base electroplate side. The area on the far right is uncoated base steel and has experienced massive red rust corrosion.

The zinc diffused nickel alloy coatings of the present invention provide substrates, particularly those used in gas turbine engines, an excellent ability to resist corrosion and to withstand temperatures in excess of 900° F. (482° C.).

It is apparent that there has been provided in accordance with the present invention a zinc-diffused nickel alloy coating for corrosion and heat protection which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A method for forming a corrosion and heat protective coating on a substrate comprising the steps of:

forming a nickel base coating layer on said substrate;

applying a layer of zinc over said nickel base coating layer;

diffusing the zinc into said nickel base coating layer; and said diffusing step comprising carrying out a thermal diffusion cycle in at least one of an atmospheric and an inert gas oven at a temperature in the range of 600 to 800° F. for a time of at least 100 minutes.

2. A method according to claim 1, wherein said nickel base coating layer forming step comprises electrodepositing a layer of nickel or nickel alloy onto a surface of said substrate.

3. A method according to claim 1, wherein said nickel base coating layer forming step comprises forming a layer of nickel or nickel alloy having a thickness in the range of 2.0 to 20 $\mu$m.

4. A method according to claim 1, wherein said nickel base coating layer forming step comprises forming a layer of nickel or nickel alloy having a thickness in the range of from 2.0 to 14.0 μm.

5. A method according to claim 1, wherein said nickel base coating layer forming step comprises forming a layer of nickel or nickel alloy having a thickness in the range of from 8.0 to 11 μm.

6. A method according to claim 1, wherein said nickel base coating layer forming step comprises forming a layer of nickel or nickel alloy on a steel substrate.

7. A method according to claim 1, wherein said nickel base coating layer forming step comprises forming a layer of nickel alloy on a component used in a gas turbine engine.

8. A method according to claim 1, wherein said nickel base coating layer step comprises forming a layer of a nickel alloy selected from the group consisting of a nickel cobalt alloy, a nickel iron alloy, a nickel manganese alloy, a nickel molybdenum alloy, and a nickel tin alloy.

9. A method according to claim 1, wherein said zinc layer applying step comprises forming an electroplating solution containing a zinc metal concentration of between 8.0 and 45.0 g/l and electroplating said layer of zinc onto said nickel alloy layer.

10. A method according to claim 1, wherein said zinc layer applying step comprises forming a layer of zinc having a thickness in the range of 0.8 to 14 μm.

11. A method according to claim 1, wherein said zinc layer applying step comprises forming a layer of zinc having a thickness in the range of 2.0 to 14 μm.

12. A method according to claim 1, wherein said zinc layer applying step comprises forming a layer of zinc having a thickness in the range of 4.0 to 7.0 μm.

13. A method according to claim 1, wherein said thermal diffusion cycle comprises heating said nickel base coated substrate with said layer of zinc to a first temperature in the aforesaid range for a time period in the range of 80 to 100 minutes and then to a second temperature higher than the first temperature for a time period in the range of 20 to 60 minutes.

14. A method according to claim 1, further comprising immersing said substrate in a phosphate trivalent chromium conversion solution.

15. A method according to claim 14, wherein said immersing step is performed after said zinc layer applying step and before said diffusion step.

16. A method according to claim 14, wherein said immersing step comprises immersing said substrate into a solution comprising a water soluble trivalent chromium compound, a water soluble fluoride compound and a corrosion resistance improving additive.

17. A method for forming a corrosion and heat protective coating on a substrate comprising the steps of:

forming a nickel base coating layer on said substrate;

applying a layer of zinc over said nickel base coating layer;

diffusing the zinc into said nickel base coating layer;

immersing said substrate in a phosphate trivalent chromium conversion solution; and said immersing step being performed after said zinc layer applying step and before said diffusion step.

18. A substrate having at least one surface and a zinc diffused nickel alloy coating on said at least one surface, said coating having a nickel or nickel alloy layer into which zinc atoms have diffused and a zinc layer into which nickel atoms have diffused, and said nickel alloy being formed from a nickel cobalt alloy having a cobalt content in the range of 7.0 to 40 wt %.

19. A substrate according to claim 18, wherein said substrate is formed from steel.

20. A method for forming a corrosion and heat protective coating on a substrate comprising the steps of:

forming a nickel base coating on said substrate;

applying a layer of zinc over said nickel base coating layer;

diffusing the zinc into said nickel base coating layer; and atmospheric and an inert gas oven at a temperature of at least 600° F. for a time sufficient to diffuse said zinc into said nickel base coating.

21. A method according to claim 20, further comprising forming said substrate from a low carbon steel material.

* * * * *

UNITED STATES PATENT AND TRADEMARK OFFICE

CERTIFICATE OF CORRECTION

PATENT NO. : 6,756,134 B2
APPLICATION NO. : 10/252867
DATED : June 29, 2004
INVENTOR(S) : Henry M. Hodgens et al.

It is certified that error appears in the above-identified patent and that said Letters Patent is hereby corrected as shown below:

Column 6,
Line 7, before "atmospheric" insert -- said diffusing step comprising carrying out a thermal diffusion cycle in at least one of an --.

Signed and Sealed this

Twentieth Day of June, 2006

JON W. DUDAS
*Director of the United States Patent and Trademark Office*